United States Patent [19]

Bertolini et al.

[11] 3,971,122

[45] July 27, 1976

[54] METHOD OF ASSEMBLING SHIPPING CONTAINER

[76] Inventors: William A. Bertolini, c/o Bertolini Engineering Co., Inc., Undercliff Terrace, Kinnelon, N.J. 07405; Isadore Feinberg, c/o Bertolini Engineering Co., Inc., P.O. Box 338, Montgomeryville, Pa. 18936

[22] Filed: Oct. 31, 1974

[21] Appl. No.: 519,889

[52] U.S. Cl. ..... 29/469; 220/1.5

[51] Int. Cl.[2] ..... B23P 21/00

[58] Field of Search ..... 29/469, 464, 428, 429, 29/430; 220/1.5; 52/745, 747; 105/366

[56] References Cited

UNITED STATES PATENTS

| | | | |
|---|---|---|---|
| 3,128,897 | 4/1964 | Wilkins | 220/1.5 |
| 3,456,830 | 7/1969 | Golder | 220/1.5 |
| 3,553,823 | 1/1971 | Alfredsson | 29/471.1 |
| 3,561,633 | 2/1971 | Morrison | 220/1.5 |
| 3,684,122 | 8/1972 | Bonomi | 220/1.5 |
| 3,828,965 | 8/1974 | Yarbrough | 220/1.5 |
| 3,834,575 | 9/1974 | Carr | 220/1.5 |

*Primary Examiner*—C. W. Lanham
*Assistant Examiner*—James R. Duzan
*Attorney, Agent, or Firm*—Seidel, Gonda & Goldhammer

[57] ABSTRACT

The method of assembling a large shipping container of the type adapted to be removably secured to the chassis of a tractor trailer on a production line basis includes producing rectangular front, rear top and bottom assemblies each having common locater points thereon, joining said assemblies to form a rectangular structure in a manner so that each locater point mates with another thereby producing a container with exact controlled external dimensions. At least one door is applied to the rear assembly.

9 Claims, 6 Drawing Figures

FIG. 1
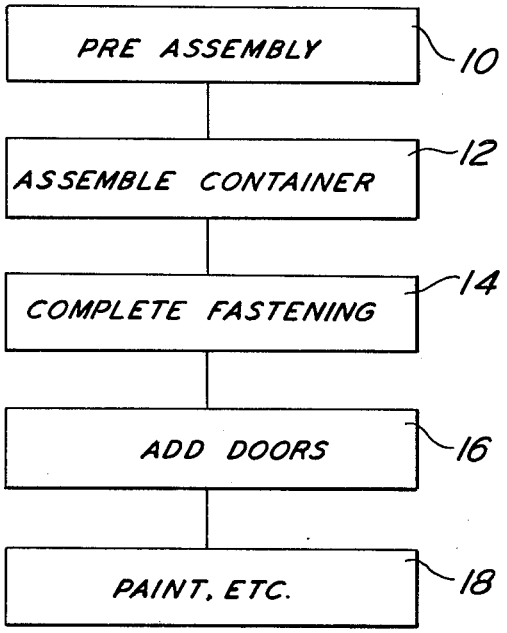
FIG. 4
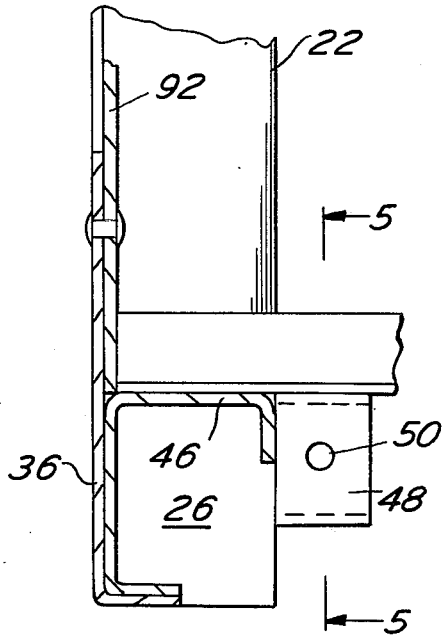
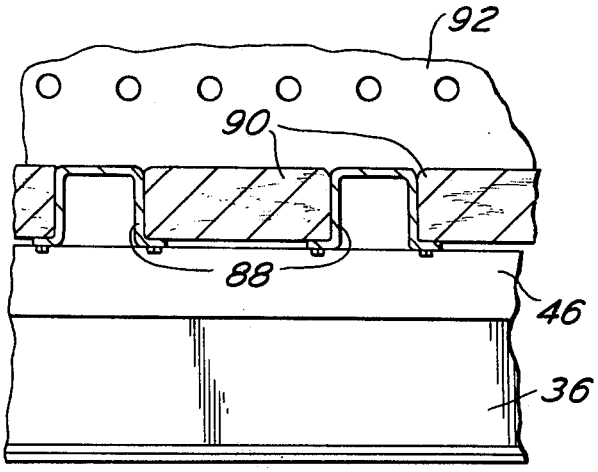
FIG. 5
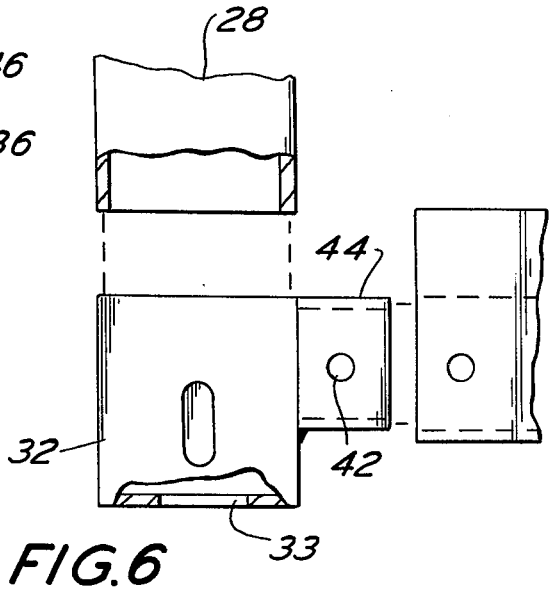
FIG. 6

METHOD OF ASSEMBLING SHIPPING CONTAINER

BACKGROUND

Shipping containers of the type involved herein have been assembled heretofore at one location by the use of large complex and expensive jigs and fixtures. The method of the present invention enables the container to be assembled on a production line basis thereby avoiding the bottleneck resulting from assembly of an entire container in substantially one location.

The present invention is directed to the method of making large shipping containers of the type which are removably secured to the chassis of a tractor trailer. The method includes producing a rectangular front and rear assembly each having a header and sill connected to corner posts. Each header on each assembly has two locater points in a horizontal plane. Each corner post of each assembly is provided with a locator point in a vertical plane adjacent one end of the corner post. Locater holes are precisely located from external faces of corner posts.

The method of the present invention also includes producing a rectangular roof assembly and a rectangular floor assembly each having two precisely positioned locater points at each end thereof. The thusly described assemblies are joined to form a rectangular box in a manner so that each locater point mates with another locater point. By so doing, the container can be assembled with only eight fasteners to derive the desired external dimensions. Thereafter, the thusly assembled box is moved down the production line and stopped at appropriate locations for further steps which include applying many additional fasteners at areas where jigs are not needed. At a subsequent step, at least one door will be applied to the rear assembly. If desired, further steps may include the finishing of the container such as by painting the same.

Production of large shipping containers in accordance with the present invention can be accomplished at a faster production rate with a smaller investment for jigs and fixtures while at the same time producing a container which more fully complies with the specifications in that it is less likely to be rejected at an inspection station because the size is outside acceptable tolerance sizes.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a block diagram showing sequence of steps.

FIG. 4 is a sectional view taken along the line 4—4 in FIG. 2.

FIG. 5 is a sectional view taken along the line 5—5 in FIG. 4.

FIG. 6 is an exploded view of a corner casting and the elements to be joined thereto.

Figure 2:
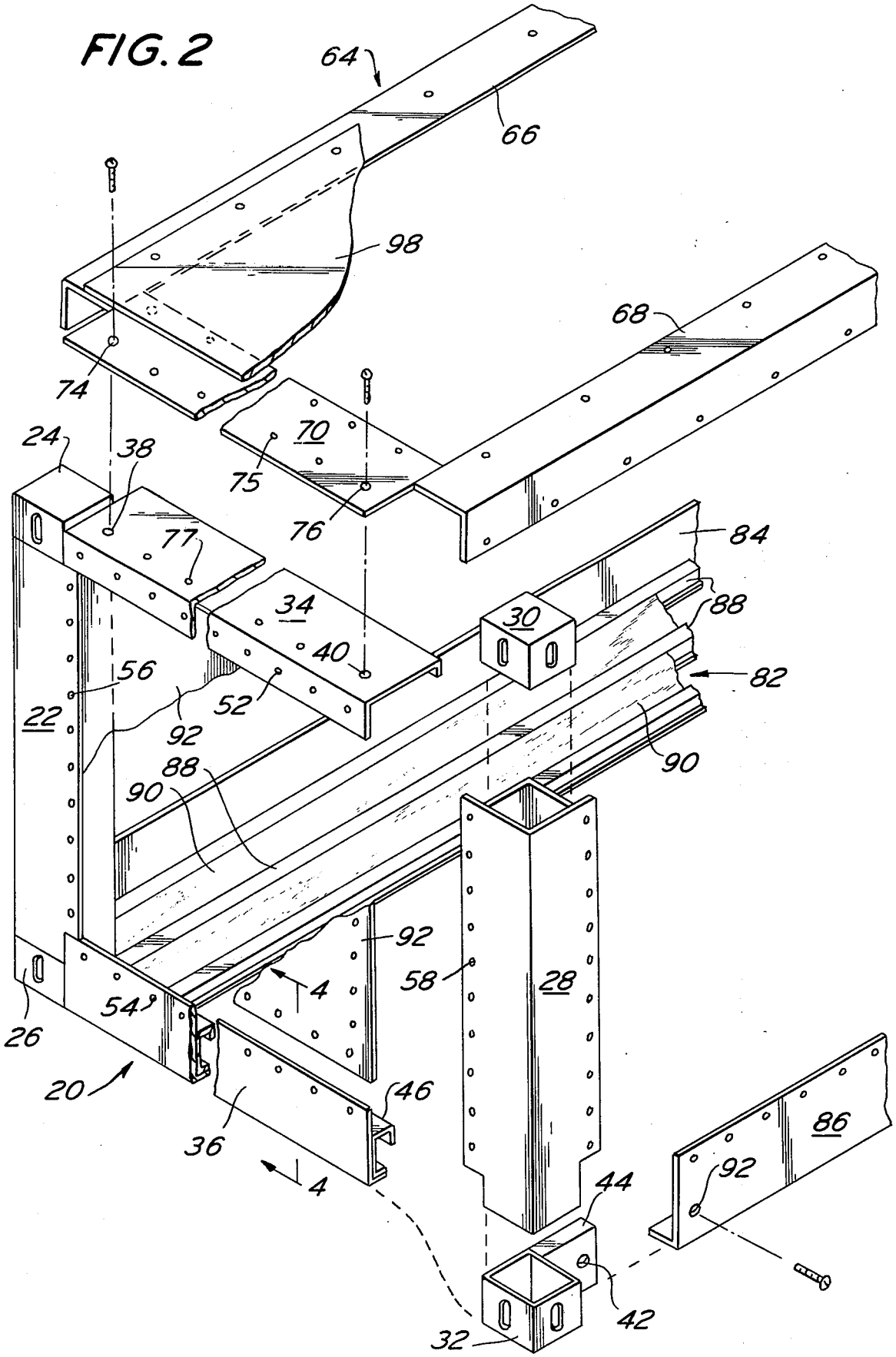
FIG. 2 is an exploded partial perspective view of the front end of the container skelton.

Referring to the drawing in detail, wherein like numerals indicate like elements, there is shown in FIG. 1 a sequence of steps designated 10, 12, 14, 16 and 18. If the components of the skeleton and the panels in steps

12 and 14 are prepainted, step 18 may be deleted. The various steps occur at different stages along a production line. Movement of components and a partially assembled container along the production line is accomplished in any conventional manner.

The initial step 10 involves preassembling a rectangular front assembly, rear assembly, roof assembly, and floor assembly. The front and rear assemblies are preferably identical except as will be made clear hereinafter. Hence, only production of the front assembly will be described in detail.

Referring to FIG. 2, the front assembly 20 includes a corner post 22 having an upper corner casting 24 and a lower corner casting 26. The front assembly 20 includes a corner post 28 having an upper corner casting 30 and a lower corner casting 32. The corner castings preferably have openings on two side faces thereof. Each of the lower corner castings 26, 32 are preferably provided with another opening 33 in a bottom face thereof to facilitate removable coupling of the container to locks on a chassis of a tractor trailer as disclosed in U.S. Pat. No. 3,737,135.

The components of the front assembly 20 are preferably assembled in a jig so as to be properly located and spaced from one another in a plane. Conventional joining techniques such as nuts and bolts, welding, and the like may be utilized to interconnect the upper corner castings 24 and 30 with a header 34 and to interconnect the lower corner castings 26, 32 with a sill 36. Header 34 is provided with two locater points in a horizontal plane. The locater points are preferably holes 38, 40 provided on a horizontally disposed top surface of the header 34.

As shown in FIGS. 2 and 6, lower corner casting 32 is provided with a tab or extension 44 containing a locater point in the form of hole 42. The tab 44 is vertically disposed. Lower corner casting 26 is similarly provided with a vertically disposed tab or extension 48 having a locater point in the form of hole 50. Hole 50 is aligned with hole 42.

As will be apparent from FIGS. 2 and 4, corner posts 22 and 28 as well as the header 34 and sill 36 have a face which may lie in a common vertical plane. As shown in FIG. 4, the sill 36 is L-shaped in cross section. An inwardly directed flange on sill 36 supports a reinforcing channel-shaped member 46 secured thereto.

A vertically disposed flange on the header 34 is provided with a row of holes 52. A vertically disposed portion of the sill 36 is provided with a row of holes 54. A flange on the corner post 22 is provided with a row of holes 56. A similar flange on corner post 28 is provided with a row of holes 58. The purpose of the rows of holes 52, 54, 56 and 58, which lie in the same plane, will be made clear hereinafter.

Figure 3:
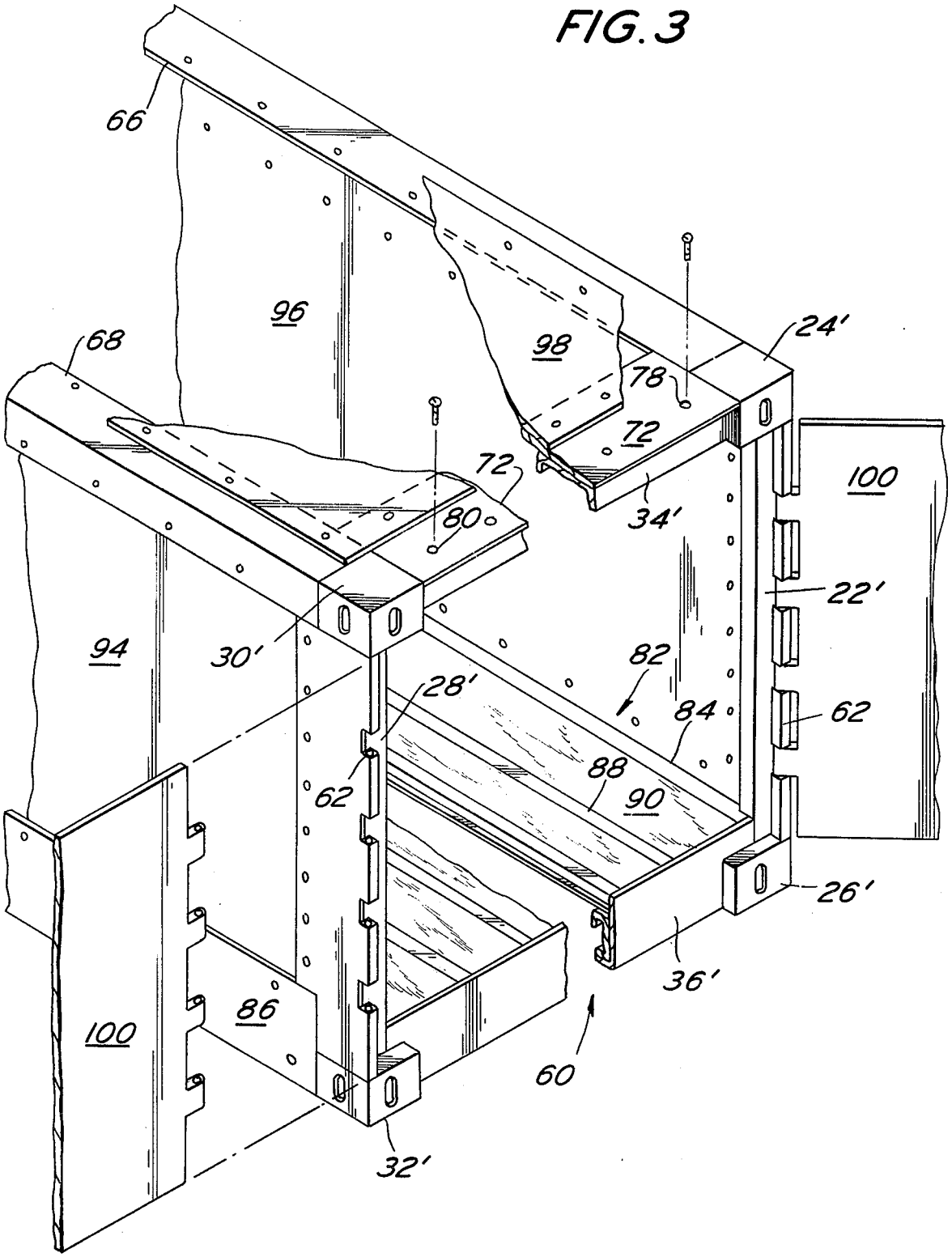
FIG. 3 is an exploded partial perspective view of the rear end of the container.

As shown more clearly in FIG. 3, the rear assembly 60 is substantially the same as the front assembly 20 and hence corresponding elements are identified by corresponding primed numerals. The rear assembly 60 does not include the rows of holes 52–58. Instead, one or both of the corner posts 22′, 28′ is provided with a hinge 62. Further, it will be noted that the header 34′ and sill 36′ are slightly recessed with respect to their corner castings.

As part of step 10, a roof assembly 64 is produced. The roof assembly 64 includes angle shaped side rails 66 and 68 interconnected at one end by a transverse front member 70 and at their other end by a transverse rear member 72. Member 70 is provided with two locater points preferably in the form of holes 74, 76. Similar locator points in the form of holes 78, 80 are provided on the member 72. Holes 74, 76 are adapted to mate or align with holes 38, 40 respectively. Holes 78, 80 are adapted to be aligned or mate with holes on header 34'. Step 10 can include applying panels to the assemblies.

Step 10 also includes producing a floor assembly 82. Floor assembly 82 includes side rails 84 and 86 connected to undulating floor hats 88 with a planking 90 recessed between adjacent floor hats.

Adjacent one end of the floor assembly 82, each of the side rails 84 and 86 is provided with a locater point in a vertical plane such as hole 92. A similar locater point is provided at the other ends of each of the rails 84 and 86. Each locater point 92 is adapted to be aligned or mate with a locater point on a corner casting such as hole 42 on corner casting 32. The rails 84 and 86 are formed so that they may receive the tab or projection on their associated corner castings.

Each of the front assembly 20 and rear assembly 60 have two locater points in a horizontal plane and two locater points in a vertical plane. The roof assembly 64 has two locater points in a horizontal plane at each end thereof. The floor assembly has two locater points in a vertical plane at each end thereof.

Step 12 involves joining assemblies 20, 60, 64 and 82 to form a rectangular skeleton. A suitable simple jig or fixture may be provided at the location of step 12 to confirm that the front and rear assemblies 20 and 60 are vertically disposed while the roof and floor assemblies 64, 82 are horizontally disposed during assembly of the rectangular skeleton. Each locater point will be aligned or mate with another locater point on another assembly. A bolt, rivet, or the like may be utilized to join the assemblies at the locater points to thereby produce a rectangular skeleton which is dimensionally stable in vertical and horizontal planes. Alternatively, or in addition to said fasteners, the assemblies may be metallurgically joined as by welding.

Step 12 preferably includes applying panels to the assemblies if not previously applied as part of Step 10. The panels may be painted or unpainted and may be made of metal, wood, plastic or the like. A front panel 92 is joined to the front assembly 20 at the location of the holes 52–58 by means of bolts, screws, rivets or the like. In a similar manner, a side panel 94 is joined to corner posts 28, 28' and to the rails 68, 86. A similar side panel 96 is provided on the opposite side of the container. A top panel 98 is applied to the roof assembly 64.

The thusly formed box is removed from the jig and moved along the production line where step 14 is performed. At step 14, the joining of the assemblies to form a rigid container is completed. This entails applying other fasteners, welding, and the like. For example, roof assembly 64 is rigidly connected to front assembly 20 by applying a bolt or rivet to each of the mating holes 75, 77.

The thusly formed box is moved along the production line where step 16 is performed. One or more doors 100 is attached to the rear assembly 60 at the hinges 62.

At step 18, panels 92, 94, 96 and 98 are painted if they have not previously been painted or otherwise provided with a decorative outer layer. As used herein, the painting step includes painting any name, mark or insignia on the panels. At step 18, any hardware, nameplates, directional information, and the like is applied.

Thus, the shipping container which may be 20, 30 or 40 feet long is assembled in a manner conducive to a production line. It will be noted that the panels 92–98 are fastened after the container which is dimensionally stable in horizontal and vertical planes has been preassembled. While the locater points are preferably holes as described above, the locater points may assume other configurations such as a mating notch and tab, a mating pin and hole, etc. While the reinforcement member 46 on the sills 36, 36' is utilized to support the floor hats 88 and planking 90, other components of the container may be utilized to accomplish this function. Also, the floor may have a construction other than that as shown in FIG. 5.

The present invention may be embodied in other specific forms without departing from the spirit or essential attributes thereof and, accordingly, reference should be made to the appended claims, rather than to the foregoing specification as indicating the scope of the invention.

I claim:

1. An assembly line method of making large containers comprising the steps of:

a. preassembling rectangular front and rear assemblies having a header and a sill connected at corner posts at a first location, b. providing one of said sill and header on each assembly with two locater points in a surface thereon lying in a horizontal plane, providing each corner post with a locater point in a side surface lying in a vertical plane adjacent one end of the corner post, said side surfaces being parallel to each other and perpendicular to said horizontal plane, c. producing an open rectangular roof assembly having two locater points on each end thereof at a second location, d. producing a rectangular floor assembly with a locater point in a vertical surface at each corner thereof at a third location, e. rigidly joining said assemblies at a fourth location to form a rectangular skeleton in a manner so that each locater point on one assembly mates with another locater point on another assembly to thereby establish precise overall container dimensions, f. then applying panels to the front, side and top of said skeleton, and g. applying at least one door to said rear assembly after the rear assembly has been interconnected with other assemblies to form said skeleton.

2. A method in accordance with claim 1 including providing the locater points in a vertical plane on the front and rear assemblies so that they are supported by lower corner castings on the front and rear assemblies.

3. A method in accordance with claim 1 wherein said locater points in a horizontal plane on the front and rear assemblies are on the header for mating relationship with locater points on said roof assembly.

4. A method in accordance with claim 3 wherein said locater points in a vertical plane are on an extension of lower corner castings attached to the corner posts, said joining step including telescoping said corner casting extensions into hollow side rails of the floor assembly to mate each locater point on the floor assembly with a locater point on the corner casting extension.

5. A method of making large shipping containers in an assembly line manner comprising:

a. preassembling rectangular front and rear assemblies each having a header and a sill connected to corner posts having corner castings, b. providing each of said assemblies with two locater points for cooperation with mating locater points on a roof assembly and two locater points for cooperation with mating locater points on a floor assembly, c. preassembling a rectangular floor assembly having two locater points at each end thereof, d. preassembling an open rectangular roof assembly having two locater points at each end thereof, e. joining and rigidly fastening said assemblies to form a dimensionally stable skeleton at a location different from the location of said preassembling steps including mating each locater point on said roof assembly with a locater point on said front and rear assemblies and mating each locater point on said floor assembly with a locater point on said front and rear assemblies, then applying panels to at least some of said assemblies to provide an enclosed shipping container having an access door.

6. A method in accordance with claim 5 wherein step (b) includes providing the two locater points in a horizontal plane on the header of the front and rear assemblies for cooperation with the mating locater points on the roof assembly, and the step of providing locater points for cooperation with a floor assembly which includes providing one locater point on a vertically disposed side surface of each lower corner casting.

7. A method in accordance with claim 5 wherein at least the lower corner castings on said front and rear assemblies are hollow and have an access opening so that a locking device may be inserted thereinto for removably locking the container to another structure.

8. A method in accordance with claim 5 wherein said locater points are holes and said joining steps includes introducing a fastener into mating holes.

9. A method in accordance with claim 8 wherein said fastening step includes bolting adjacent portions of some of said assemblies.

* * * * *